US010190764B2

(12) United States Patent
Zhang

(10) Patent No.: US 10,190,764 B2
(45) Date of Patent: Jan. 29, 2019

(54) INFRARED HYDROGEN/OXYGEN COMBUSTOR

(71) Applicant: XIAMEN YUANYIDA TECHNOLOGY CO., LTD., Xiamen (CN)

(72) Inventor: Daji Zhang, Ningde (CN)

(73) Assignee: XIAMEN YUANYIDA TECHNOLOGY CO., LTD., Xiamen (CN)

( * ) Notice: Subject to any disclaimer, the term of this patent is extended or adjusted under 35 U.S.C. 154(b) by 0 days.

(21) Appl. No.: 15/813,379

(22) Filed: Nov. 15, 2017

(65) Prior Publication Data

US 2018/0073721 A1 Mar. 15, 2018

Related U.S. Application Data

(63) Continuation of application No. PCT/CN2016/000241, filed on May 5, 2016.

(30) Foreign Application Priority Data

May 15, 2015 (CN) ..... 2015 1 0263022

(51) Int. Cl.

| | |
|---|---|
| ***F23D 14/46*** | (2006.01) |
| ***F22B 1/00*** | (2006.01) |
| ***F23D 14/14*** | (2006.01) |

(52) U.S. Cl.

CPC ..... *F22B 1/003* (2013.01); *F23D 14/14* (2013.01)

(58) Field of Classification Search

CPC ..... F23D 14/12; F23D 14/46; F23D 14/18; F22B 1/00; F22B 1/003

See application file for complete search history.

(56) References Cited

U.S. PATENT DOCUMENTS

| | | | | |
|---|---|---|---|---|
| 5,586,877 A * | 12/1996 | Charmes | ..... | F23C 5/06 431/115 |
| 7,661,420 B2 * | 2/2010 | Okayasu | ..... | F23C 3/00 122/17.1 |
| 2002/0064487 A1 | 5/2002 | Sederquist et al. | | |

FOREIGN PATENT DOCUMENTS

| | | |
|---|---|---|
| CN | 201072122 Y | 6/2008 |
| CN | 201421074 Y | 3/2010 |
| CN | 102022757 B | 5/2012 |

(Continued)

*Primary Examiner* — Gregory A Wilson

(74) *Attorney, Agent, or Firm* — Wayne & Ken, LLC; Tony Hom

(57) ABSTRACT

The present invention provides an infrared hydrogen/oxygen combustor. The structure of the combustor includes a sinus ring (1). A surrounding foot (12) of the angle-shaped sinus ring (1) wraps a material-containing basin (14). A first small tube (16) and a second small tube (7) are connected the material-containing basin (14) and the angle-shaped sinus ring (1). Water solution (3) is contained in the material-containing basin (14). A straight-hole ceramic water-absorbing board (5) is provided on the upper part of the water solution (3), a spacing ring (6) is provided above the side of the material-containing basin (14) and in the upward ring of the angle-shaped sinus ring (1), a two-stage material-containing box (9) with a separated brake is provide on one side of the angle-shaped sinus ring (1). The technical scheme of the invention reduces the production cost, the pollution and protects the environment.

2 Claims, 1 Drawing Sheet

(56) References Cited

FOREIGN PATENT DOCUMENTS

| | | | |
|---|---|---|---|
| CN | 202253789 | U | 5/2012 |
| CN | 202470183 | U | 10/2012 |
| CN | 202733898 | U | 2/2013 |
| CN | 103512053 | A | 1/2014 |
| CN | 204227421 | U | 3/2015 |
| CN | 204806397 | U | 11/2015 |
| DE | 10243250 | A1 | 3/2004 |
| JP | 2001201019 | A | 7/2001 |

* cited by examiner

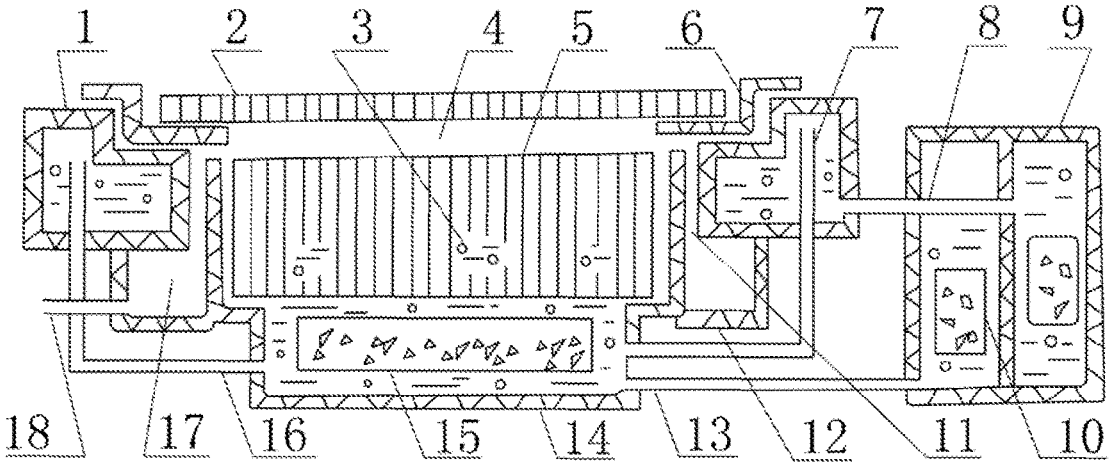
1
2
3
4
5
6
7
8
9
18
17
16
15
14
13
12
11
10

INFRARED HYDROGEN/OXYGEN COMBUSTOR

FIELD OF THE INVENTION

The present invention relates to an infrared hydrogen/oxygen combustor for combustion and heating, and more specifically, to a combustor capable of realizing stable and seamless infra-red contact with water and quickly and efficiently decomposing H2 and O2 for direct combustion.

BACKGROUND OF THE INVENTION

In the existing technology, the steam generated by the combustion of infrared fusion of water protects the infrared structure from being damaged by the high temperature on the one hand. Secondly, the combustion of steam exerts certain thermal energy. The concept of using water as a raw material for generating hydrogen is not new considering especially for the inventor's understanding for this. In a patent named "Hydraulic infrared combustor" applied in 2007, it discloses that water protects infrared system from being damaged under high temperature. A number of technical solutions have been derived from this, which by far are disclosed in the applications of CN201072122Y, CN102022757B, CN202253789U, CN202470183U, CN202733898U, CN204227421 U. The purpose of the latter is that hydrogen energy is made by taking water as raw material, this process is theoretically simple and only requires that water is moderately contacted fire. However, the degree for "moderation" is difficult to reach, thus a desired goal can barely be achieved. Through the inventor's long-term exploration, a new water vapor reaction decomposition system can be provided to facilitate "water and fire" intermingling to realize more rapid decomposition of "water" into direct combustion fuel, thereby reducing the primary energy consumption and protecting the environment.

SUMMARY OF THE INVENTION

In order to achieve the above object, the present invention uses the following technical solutions:

The present disclosure comprises, as in the prior art, a primary combined combustion structure for decomposing infrared radiation "water" by heat and producing steam. The present structure of the combustor is characterized by including an angle-shaped sinus ring (1) with a surrounding foot for water passing, absorbing heat and producing gas. The surrounding foot (12) of the angle-shaped sinus ring (I) wraps a material-containing basin (14). A gas-gathering chamber (17) is formed between the outer wall of the material-containing basin (14) and the inner wall of the surrounding foot (12) at the lower part of the angle-shaped sinus ring (1), a primary energy gas inlet (18) is provided on one side of the gas-gathering chamber (17), a first small tube (16) and a second small tube (7) are connected the material-containing basin (14) and the angle-shaped sinus ring (1) to exchange water, water vapor and air, a water solution (3) is provided in the material-containing basin (14), a first catalytic material barrier (15) is arranged in the water solution (3) at the lower part of the material-containing basin (14), a straight-hole ceramic water-absorbing board (5) is provided on the upper part of the water solution (3) and is matched with the inner wall of the material-containing basin (14), the middle lower part of the water-absorbing board (5) is soaked in the water solution (3), that is, full range of solution positioning, a spacing ring (6) is provided above the side of the material-containing basin (14) and in the upward ring of the angle-shaped sinus ring (I), an infrared radiation board (2) is arranged relatively to the inner surface of the spacing ring (6), and the hole number of the water-absorbing board (5) and the infrared radiation board (2) is identical, and the holes of the water-absorbing board (5) and the infrared radiation board (2) are corresponding, a two-stage material-containing box (9) with a separated brake is provide on one side of the angle-shaped sinus ring (1), the two-stage material-containing box (9) is communicated with the angle-shaped sinus ring (1) and material-containing basin (14) respectively by a third small tube (8) and a forth small tube (13), so that the original water and the added water can be controlled separately, and the original water in the material-containing basin (14) can be supplied on demand, and.

The present invention has the following significant advantages over the prior art disclosed:

The invention adopts a basin-shaped superficial moisture material-containing basin to reduce the volume, reduces the heating load, and realizes the acceleration of the heat transmission rate; the material barrier is provided to form a gap for keeping water or for flowing water and not only reduces the water capacity but also increases the expansion of the water surface, the pure water is metamorphic into a high concentration of brine catalyst solution to achieve rapid thermal decomposition of catalytic reaction. Permeability of water within the basin with straight hole ceramic water-absorbing board can achieve good water permeability, resistance to soaking, non-deterioration, and play the role of self-absorption of light radiation. The water level reaches at the center of the board to make the water in the vertical hole contacted with fire point, it overcomes the disadvantages that open fire can not be synchronously steamed and decomposed with fire, secluded water layout is adopted, and the method of supplying water by water-absorbing material is not easy to be controlled, etc.

The infrared radiation board on the upper part of the material-containing basin is arranged corresponding to the ceramic water-absorbing board on the lower part of the material-containing basin, and there is a gap between the infrared radiation board and the ceramic water-absorbing board so that the steam matches with each other and water does not touch, and water can not reach to the surface of the board to form incrustation and stains, water is led to the effective heating position, the redness of the infrared radiation board is improved, the infrared ray is enhanced to be perpendicular incidence to the bottom of hole net of the ceramic water-absorbing board, the area of the mesh to evaporate is increased and efficiency is increased. The placement of the infrared radiation board and the sinus ring is integrated, water in the sinus ring is rapidly heated by the high temperature round edge of the infrared radiation board and produces steam to transfer to the material-containing basin, so that water in the basin is heated to be expanded to rise up to accelerate evaporation decomposition by forming a circulating thermal effect, and overcome the shortcomings of the ineffective infiltration and heat loss of the added water in the past.

The surrounding foot on the lower part of the sinus ring enfolds the material-containing basin to form transmission system of aggregating primary energy gas, empty space is formed naturally in the cavity to reduce the momentum, the primary energy gas is buffered at the corner of the angle-shaped sinus ring, and rise to the bottom side of the spacing ring through a parietal suture and are evenly distributed in a lateral gap between the lower surface of the infrared radiation board and the upper surface of the water-absorbing board, aqueous solution vapor mixed contact reaction modification and infrared light irradiation play a thermal chemical reaction, the combination of light-ray electromagnetic decomposition of water vapor to overcome the past with the internal components of the wall gas barrier gas balance method, it is difficult to adjust adapt to the problem.

Meanwhile, the foundation of the material-containing box arranged on the outer side is separating the original water from the added water, controlling the water capacity in the basin, overcoming the negative effect produced by entering too much or too little water, and the concentration of catalyst in aqueous solution is increased by putting the catalytic material in the material-containing box, decomposition of the reaction is increased. The method of supplying water in the material-containing box: according to adjust the structure of the combustion heating, hot water or steam is introduced into the fixed heater to avoid reducing efficiency for filling cold water, the adjustment of the structure of the combustion heating is like configuring kitchen stove, concealed waterways can be embedded in the eyelets or fire shelves of their cooktops to intercept negative radiation to provide heat to the material-containing box, Contribute to the full and effective display of the dual-to-multiple functions and hidden potential between the components and components of the present invention to support system-wide energy efficiency improvements.

BRIEF DESCRIPTION OF THE DRAWINGS

Further explanation is described in conjunction with the drawings.

FIG. 1 is a schematic structural view of an embodiment of the present invention.

DETAILED DESCRIPTION OF THE INVENTION

Embodiment 1

The structure of the combustor is an angle-shaped sinus ring (1) with a surrounding foot can pass water vapor, the angle-shaped sinus ring (1) can take in water and product water vapor, a surrounding foot (12) of the angle-shaped sinus ring (1) is wrapped with a material-containing basin (14), a gas-gathering chamber (17) is formed between the outer wall of the material-containing basin (14) and the inner wall of the surrounding foot (12) at the lower part of the angle-shaped sinus ring (1), a primary energy gas inlet (18) is provided on one side of the gas-gathering chamber (17), the primary energy gas is buffered at the corner of the angle-shaped sinus ring (1), and rise to the bottom side of the spacing ring (6) through a parietal suture (11) and are evenly distributed in a lateral gap (4) between the lower surface of the infrared radiation board (2) and the upper surface of the water-absorbing board (5), aqueous solution gas mixed contact reaction and infrared light irradiation can modify the thermal chemical reaction and realize decomposition of water vapor by the combination of light-ray electromagnetic.

A first small tube (16) and a second small tube (7) are connected with the material-containing basin (14) and the angle-shaped sinus ring (1), the first small tube (16) is used to introduce the steam in the ring into the material-containing basin (14) to heat and promote aqueous solution floating to create the decomposition condition, while the second small tube 7 is used to introduce the steam and at the same time empty effect the sinus ring (I) to support running water into the ring. A water solution (3) is provided in the material-containing basin (14), a first catalytic material barrier (15) is arranged in the water solution (3) at the lower part of the material-containing basin (14), the effect of the first catalytic material barrier (15) is to make pure water as a brine solution catalyst that supports the hydrogenolysis; a straight-hole ceramic water-absorbing board (5) is provided on the upper part of the water solution (3) and is matched with the inner wall of the material-containing basin (14), the middle lower part of the water-absorbing board (5) is soaked in the water solution (3), that is, full range of solution positioning, the solution (3) is heated and expanded by the heating source of the sinus ring (1) to move up to the optimum decomposition reaction zone close to the fire point for decomposition; a spacing ring (6) is provided above the side of the material-containing basin (14) and in the upward ring of the angle-shaped sinus ring (I), an infrared radiation board (2) is arranged relative to the inner surface of the spacing ring (6), and the hole number of the water-absorbing board (5) and the infrared radiation board (2) is identical, and the holes of the water-absorbing board (5) and the infrared radiation board (2) are corresponding, so that the infrared light below the board (2) transmits deeply to the water-absorbing board below by mesh-to-mesh and wall-to-wall and the large-area effect in the micro-wall pores is formed to cause a variety of chemical reactions to decompose.

A two-stage material-containing box (9) with a separated brake is provided on one side of the angle-shaped sinus ring (1), the two-stage material-containing box (9) is communicated with the angle-shaped sinus ring (1) and material-containing basin (14) respectively by a third small tube (8) and a forth small tube (13), so that the original water and the added water can be controlled separately, and the original water in the material-containing basin (14) can be supplied on demand, the purpose is separating the original water from the added water, controlling the water capacity in the material-containing basin (14), and overcoming the negative effect produced by entering too much or too little water, and the concentration of catalyst in aqueous solution is increased by putting the catalytic material in the material-containing box, decomposition of the reaction is increased.

What is claimed is:

1. An infrared hydrogen/oxygen combustor in the field of combustion heating, comprising:

an angle-shaped sinus ring (1) with a surrounding foot for passing water and producing gas; a surrounding foot (12) of the angle-shaped sinus ring (1) wraps a material-containing basin (14); a gas-gathering chamber (17) is formed between an outer wall of the material-containing basin (14) and an inner wall of a lower part of the surrounding foot (12); a primary energy gas inlet (18) is provided on one side of the gas-gathering chamber (17); a first small tube (16) and a second small tube (7) are connected with the material-containing basin (14) and the angle-shaped sinus ring (1) for exchanging water, water vapor and air; water solution (3) is contained in the material-containing basin (14); a first catalytic material barrier (15) is arranged in the water solution (3) at the lower part of the material-containing basin (14); a straight-hole ceramic water-absorbing board (5) is provided on an upper part of the water solution (3) matching with an inner wall of the material-containing basin (14); a middle lower part of the water-absorbing board (5) is soaked in the water solution (3), that is, full range of solution positioning;

a spacing ring (6) is provided above the rim of the material-containing basin (14) and inside the upward ring of the angle-shaped sinus ring (1); an infrared radiation board (2) is provided in the inner surface of the spacing ring (6) having a same number of holes and facing the straight-hole ceramic water-absorbing board (5) in the material-containing basin (14); a two-stage material-containing box (9) with a separated brake is provide on one side of the angle-shaped sinus ring (1); a second catalytic material barrier (10) is provided in each of the separated brake of the material-containing box (9); the two-stage material-containing box (9) is communicated with the angle-shaped sinus ring (1) and material-containing basin (14) respectively by a third small tube (8) and a forth small tube (13), so that the original water and the added water be controlled separately; the original water in the material-containing basin (14) can be supplied on demand, and the original water is separated from the added water, the water capacity in the material-containing basin (14) is controlled, and it overcomes the negative effect produced by entering too much or too little water, and the concentration of catalyst in aqueous solution is increased by putting the catalytic material in the material-containing box, decomposition of the reaction is increased.

2. The infrared hydrogen/oxygen combustor of claim 1, wherein a function of the gas-gathering chamber (17) is that: the primary energy gas is buffered at the corner of the angle-shaped sinus ring (1), and rise to the bottom side of the spacing ring (6) through a parietal suture (11) and are evenly distributed in a lateral gap (4) between the lower surface of the infrared radiation board (2) and the upper surface of the water-absorbing board (5), aqueous solution gas mixed contact reaction and infrared light irradiation can modify the thermal chemical reaction and realize decomposition of water vapor by the combination of light-ray electromagnetic.

* * * * *